US009044767B2

(12) United States Patent
Zhu et al.

(10) Patent No.: US 9,044,767 B2
(45) Date of Patent: Jun. 2, 2015

(54) OUTFLOW SWITCH MECHANISM OF MULTIFUNCTION SHOWER HEAD

(75) Inventors: Chuanbao Zhu, Xiamen (CN); Xuedong Wang, Xiamen (CN); Jiangcheng Zhang, Xiamen (CN)

(73) Assignee: XIAMEN LOTA INTERNATIONAL CO., LTD., Xiamen, Fujian (TW)

( * ) Notice: Subject to any disclaimer, the term of this patent is extended or adjusted under 35 U.S.C. 154(b) by 53 days.

(21) Appl. No.: 13/696,307

(22) PCT Filed: Apr. 11, 2011

(86) PCT No.: PCT/CN2011/072580

§ 371 (c)(1), (2), (4) Date: Nov. 5, 2012

(87) PCT Pub. No.: WO2012/139267

PCT Pub. Date: Oct. 18, 2012

(65) Prior Publication Data

US 2014/0061339 A1 Mar. 6, 2014

(51) Int. Cl.

| | |
|---|---|
| ***B05B 1/30*** | (2006.01) |
| ***B05B 1/16*** | (2006.01) |
| *B05B 1/18* | (2006.01) |

(52) U.S. Cl.

CPC ..... *B05B 1/3073* (2013.01); *B05B 1/1663* (2013.01); *Y10S 239/11* (2013.01); *B05B 1/18* (2013.01); *B05B 1/3026* (2013.01)

(58) Field of Classification Search

CPC ..... B05B 1/12; B05B 1/1681; B05B 1/18; B05B 1/1663; B05B 1/3026; Y10S 239/11

USPC ..... 239/443, 444, 446–449, 586, DIG. 11

See application file for complete search history.

(56) References Cited

U.S. PATENT DOCUMENTS

| | | | | |
|---|---|---|---|---|
| 3,066,873 | A * | 12/1962 | Flick et al. | 239/415 |
| 5,984,207 | A * | 11/1999 | Wang | 239/526 |
| 6,619,567 | B1 * | 9/2003 | Ouyoung | 239/441 |
| 7,201,332 | B2 * | 4/2007 | Wang et al. | 239/526 |
| 7,341,239 | B2 * | 3/2008 | Hodel et al. | 251/230 |

* cited by examiner

*Primary Examiner* — Christopher Kim

(57) ABSTRACT

An outflow switch mechanism of a multi-function shower head includes an inner body, a button, a return spring, a valve shaft, a water division plate, a support press spring and a cover. The inner body has a valve chamber therein. A valve path for accommodating the valve shaft is between a seat and a chamber. The lower portion of the valve path is formed with an enlarged seat having longitudinal sliding grooves. The lower portion of the valve shaft extends into the enlarged seat. The bottom of a projecting rib formed between the sliding grooves has a gradient guide surface. The water division plate is formed with tooth blocks corresponding to the sliding grooves. The top of the tooth blocks has a gradient surface facing the gradient guide surface of the projecting rib. A magnet is fixed on the water division plate. A magnet is also provided on the cover.

9 Claims, 10 Drawing Sheets

OUTFLOW SWITCH MECHANISM OF MULTIFUNCTION SHOWER HEAD

BACKGROUND OF THE INVENTION

1. Field of the Invention

The present invention relates to a multi-function shower head, and more particularly to an outflow switch mechanism of a multi-function shower head.

2. Description of the Prior Art

Nowadays, a shower head is an essential apparatus for taking a bath. An improved shower head is developed to have different outflow modes, such as a swing outflow mode, a massage outflow mode, a bubble outflow mode and the like. The conventional shower head has multiple water passages and water chambers to cooperate with an outflow panel to achieve multi-function outflow modes. The outflow panel is turned to switch the outflow modes. The user has to switch the outflow mode with both hands. The operation way is laborious and inconvenient. If the panel is used to a non-circular shower head, it is unable to turn the panel for switching outflow mode.

German Patent No. DE 102009008196A discloses a shower head switch which can be switched with one hand. The shower head switch comprises a water division plate which has a plurality of one-way gradient gears. An outflow body has a plurality of positioning grooves and the bottom of each positioning groove has a gradient surface. A push block with two gradient toothed surfaces cooperates with a push button and a return spring to achieve rotation of the water division plate. The switch can be operated with one hand.

The switch can be operated conveniently. However, the water division plate is driven by the push block having two gradient toothed surfaces. The push block is small in size, so it is difficult to process. The structure is complicated. It is difficult to process and mate with each part. The parts will suffer a lot of wear and tear after a period of time to influence the service lift.

Accordingly, the inventor of the present invention has devoted himself based on his many years of practical experiences to solve these problems.

SUMMARY OF THE INVENTION

The primary object of the present invention is to provide an outflow switch mechanism of a multi-function shower head. The outflow switch mechanism is simple in construction, and the feeling of switching by one hand is convenient.

In order to achieve the aforesaid object, the outflow switch mechanism is disposed in a water path of the shower head and comprises an inner body, a button, a return spring, a valve shaft, a water division plate, a support press spring and a cover. The inner body has a valve chamber extending up and down. The upper portion of the valve chamber is formed with a seat to accommodate the return spring and the button. The lower portion of the valve chamber is formed with a chamber having a water inlet to accommodate the water division plate, the support press spring and the cover. A valve path for accommodating the valve shaft is defined between the seat and the chamber. The button is connected with an upper end of the valve shaft. The lower portion of the valve path is formed with an enlarged seat. The enlarged seat has longitudinal sliding grooves on a side wall thereof and a projecting rib formed between the sliding grooves. The lower portion of the valve shaft extends in the enlarged seat. The bottom of the projecting rib has a gradient guide surface. The water division plate has a toothed block on an upper central surface thereof corresponding to the sliding grooves. The top of the toothed block has a gradient surface corresponding to the gradient guide surface of the projecting rib. The water division plate further has a magnet thereon. The cover has a magnet thereon.

Preferably, the water division plate has one or more magnets.

Preferably, the number of the magnet of the cover corresponds to the number of the sliding grooves, and the number of the sliding grooves corresponds to the number of a function water chamber.

Preferably, a support block is provided at the lower end of the button for insertion of the valve shaft, and the support block cooperates with a seal member to seal the valve shaft and a valve path.

Preferably, the valve shaft is a rod, and the lower portion of the valve shaft having a stop block on a side wall thereof to slide along the sliding groove.

Preferably, the water division plate has a crescent notch and at least one toothed block on an upper central surface thereof, and the water division plate has a counterbore on a lower central surface thereof to accommodate the support press spring.

Preferably, the lower surface of the water division plate further has fixing recesses to fix two magnets, and the two magnets are disposed radially and symmetrically.

Preferably, the cover is an end cover to cover the chamber, and the cover has a central protruding post extending upward for the support press spring to fit thereon.

Preferably, the cover comprises four magnets on a lower surface thereof, and the magnets are spaced evenly and fixed on the cover.

Accordingly, the one-way bevel toothed block of the water division plate is to cooperate with the gradient guide surface of the projecting rib, and the magnet of the water division plate is to cooperate with the magnet of the cover. The water division plate will be turned by the repulsion of the homogeneous magnets to switch the water outflow mode when it departs from the inner body. The whole mechanism is simple in construction, and the parts can be processed with ease to enhance the work efficiency. The present invention uses the repulsion of the homogeneous magnets to slant the angle and the switch of the bevel toothed block, preventing the water division plate to get contact with the parts direct. The feeling of switching by one hand is convenient.

DETAILED DESCRIPTION OF THE PREFERRED EMBODIMENTS

Figure 1:
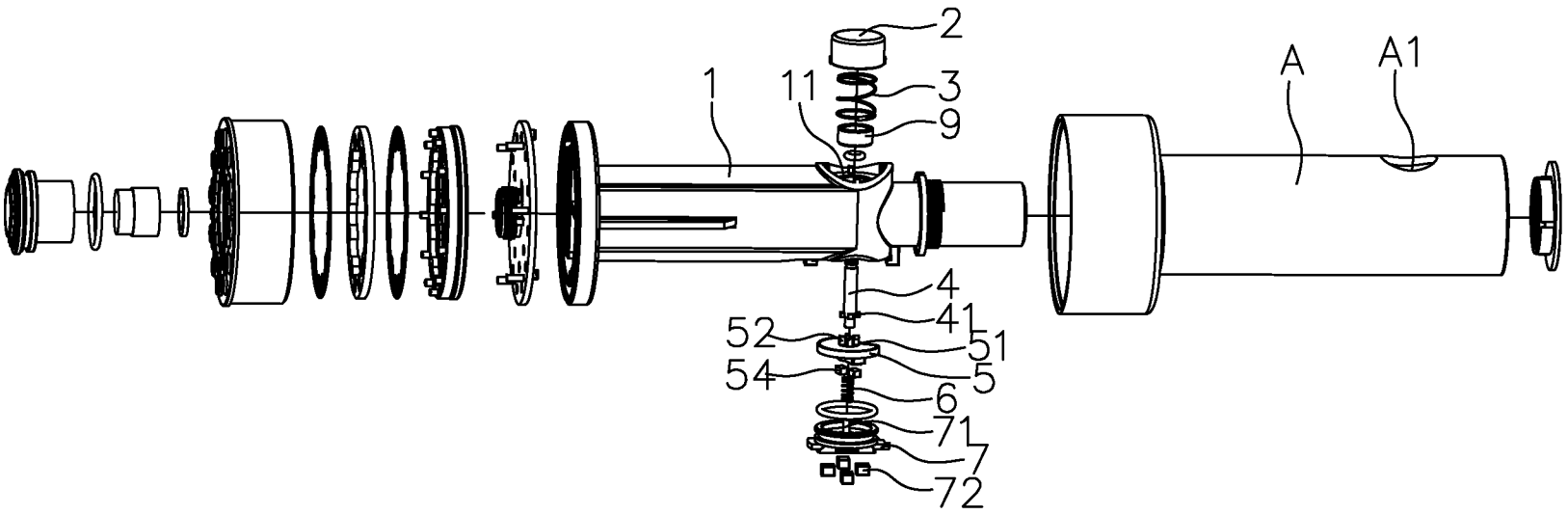
FIG. 1 is an exploded view of the present invention.

Embodiments of the present invention will now be described, by way of example only, with reference to the accompanying drawings.

As shown in FIG. 1 to FIG. 10, the present invention disclosures an outflow switch mechanism of a multi-function shower head. The outflow switch mechanism is disposed in a water path of the shower head. The outflow switch mechanism comprises an inner body 1, a button 2, a return spring 3, a valve shaft 4, a water division plate 5, a support press spring 6 and a cover 7.

The inner body 1 is a water inlet pipe of the shower head. The inner body 1 has a vertical water path with a valve chamber 11 extending up and down. The upper portion of the valve chamber 11 is formed with a seat 12 for movement of the button 2. The lower portion of the valve chamber 11 is formed with a chamber 13 for movement of the water division plate 5. A valve path 14 for accommodating the valve shaft 4 is defined between the seat 12 and the chamber 13. The lower portion of the valve path 14 is formed with an enlarged seat 15 to cooperate with the water division plate 5. The enlarged seat 15 has longitudinal sliding grooves 151 on a side wall thereof and projecting ribs 153 formed between the sliding grooves 151. The number of the sliding grooves 151 corresponds to the number of water chambers. In this embodiment, there are four sliding grooves. The bottom of each projecting rib 153 has a gradient guide surface 152. As shown in FIGS. 5, 7, 8, 10, the bottom of the chamber 13 has a water inlet 16 corresponding to different water channels to guide water into each water chamber (not shown).

The button 2 is disposed in the seat 12. The return spring 3 is disposed between the button 2 and the seat 12. The button 2 is biased by the spring 3 to extend out of the seat 12. The button 2 is connected to the upper end of the valve shaft 4 so that the button 2 and the valve shaft 4 are synchronously moved. A support block 8 is provided at the lower end of the button 2 for insertion of the valve shaft 4. The support block 8 cooperates with a seal member to seal the valve shaft 4 and a valve path 14.

The valve shaft 4 is a rod. The lower portion of the valve shaft 4 has stop blocks 41 on a side wall thereof to slide along the sliding grooves 151. The stop blocks 41 can guide the valve shaft 4 to move up and down and are confined in the enlarged seat 15 at the bottom of the valve path 14.

The water division plate 5 has a crescent notch 51 and four toothed blocks 52 on an upper central surface thereof. The number of the toothed block may be one. Four toothed blocks ensures the function of the parts. The top of each toothed block 52 has a gradient surface 521 corresponding to the gradient guide surface 152 of the corresponding sliding groove 15, namely, each toothed block 52 is a bevel gear. The water division plate 5 has a counterbore 53 on a lower central surface thereof to accommodate the support press spring 6. The lower surface of the water division plate 5 further has fixing recesses to fix magnets 54. The magnets 54 are disposed radially and symmetrically. The number of the magnets 54 may be one or more.

The cover 7 is an end cover to cover the chamber 13. The cover 71 has a central protruding post 71 extending upward for the support press spring 6 to fit thereon. The protruding post 71 extends in the counterbore 53 of the water division plate 5, providing a guide effect. A seal is provided on the outer edge of the cover 7 to seal the chamber 13. The cover 7 comprises four magnets 72 on a lower surface thereof. The magnets 72 are spaced evenly and fixed on the cover 7.

Figure 2:
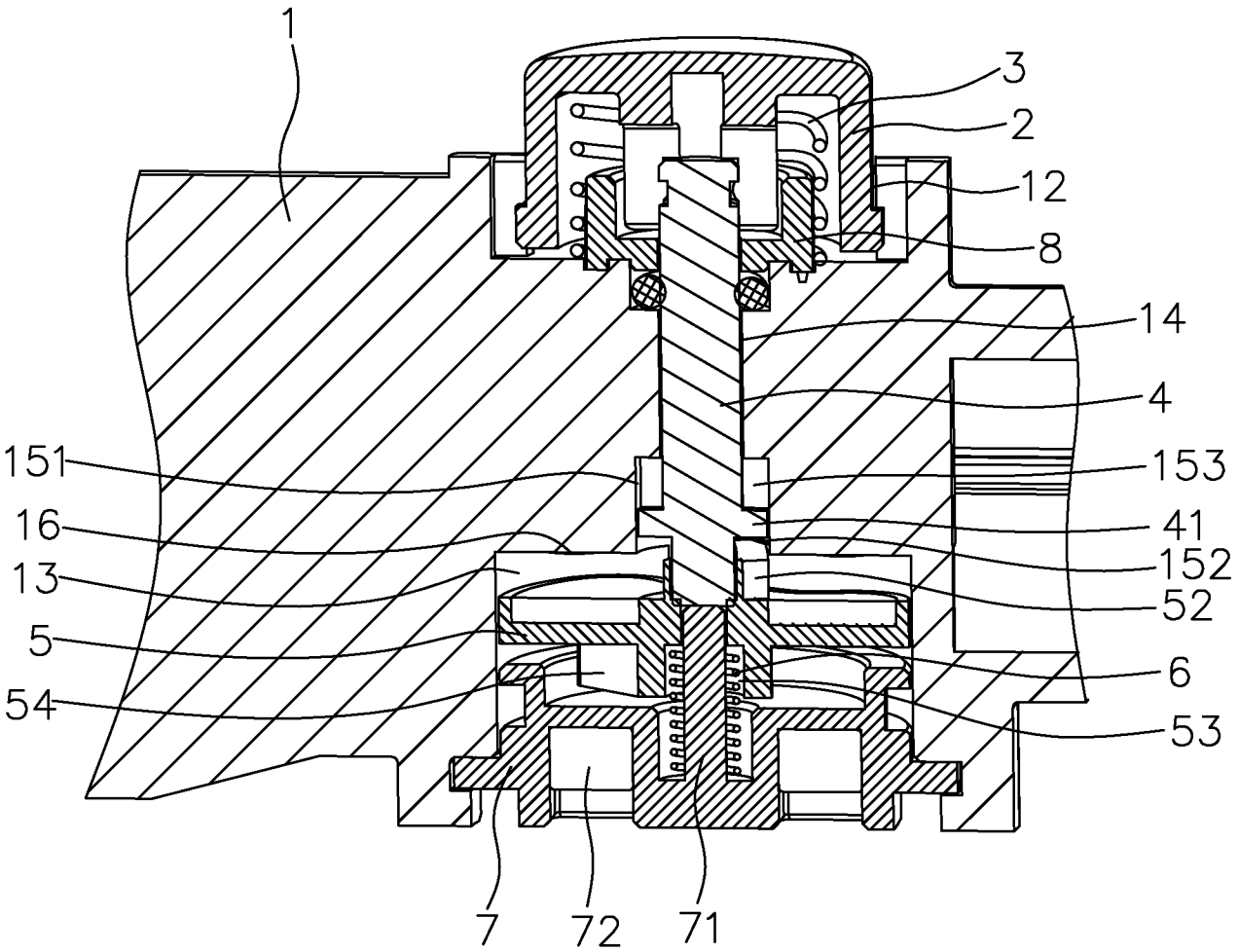
FIG. 2 is a sectional view of the present invention.
Figure 3:
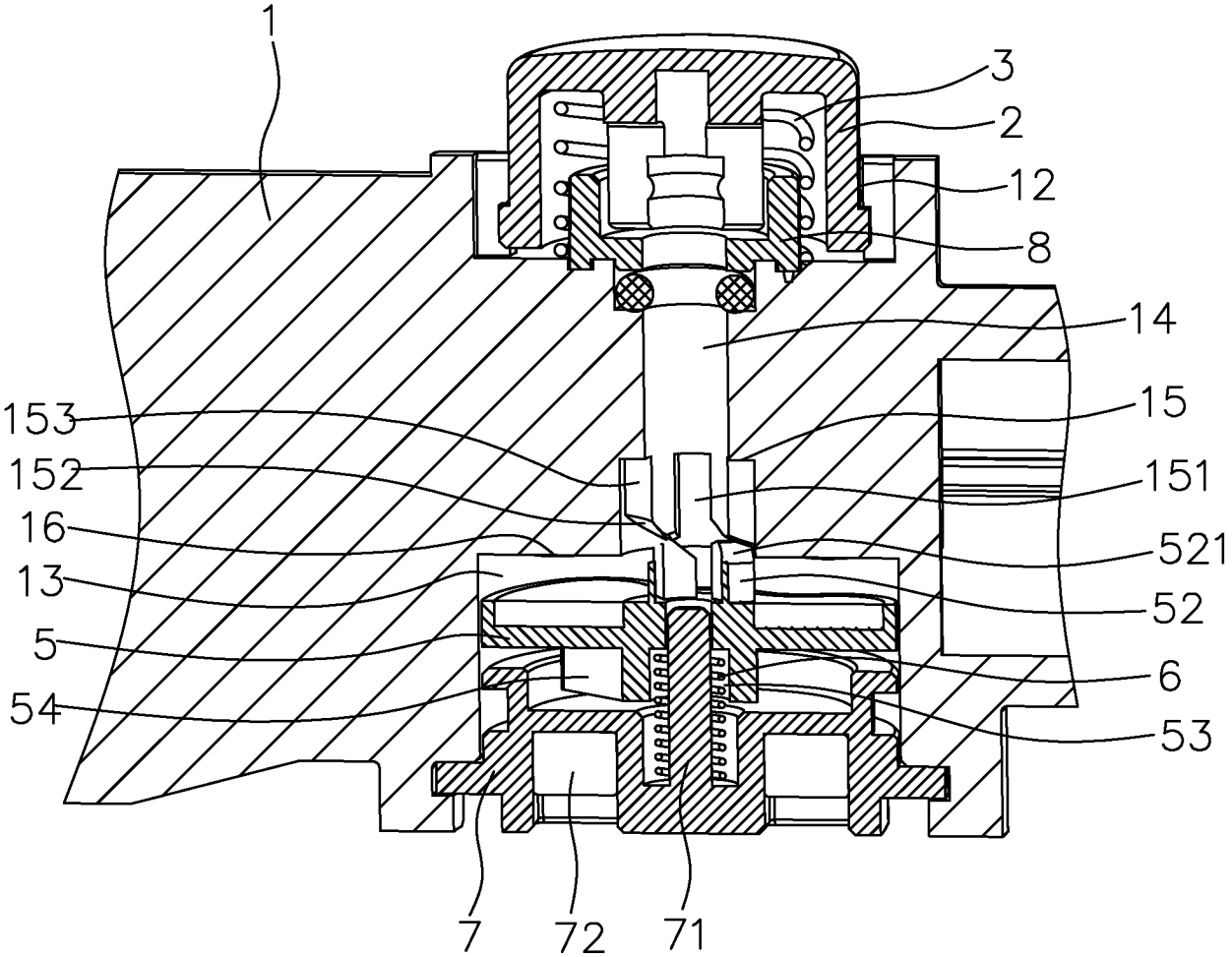
FIG. 3 is a sectional view of the present invention in a switching state.

Referring to FIG. 2 and FIG. 3, to assemble the outflow switch mechanism of the present invention, the valve shaft 4, the water division plate 5, the support press spring 6 and the cover 7 are mounted into the valve chamber 11 from bottom to up in sequence. The return spring 3 and the button 2 are mounted into the valve chamber 11 from top to bottom in sequence. Wherein, the button 2 is connected with the upper end of the valve shaft 4. As shown in FIG. 1, a shower handle housing A having a button hole A1 is fitted on the inner body 1, so that the outflow switch mechanism is installed in the multi-function shower head.

Figure 4:
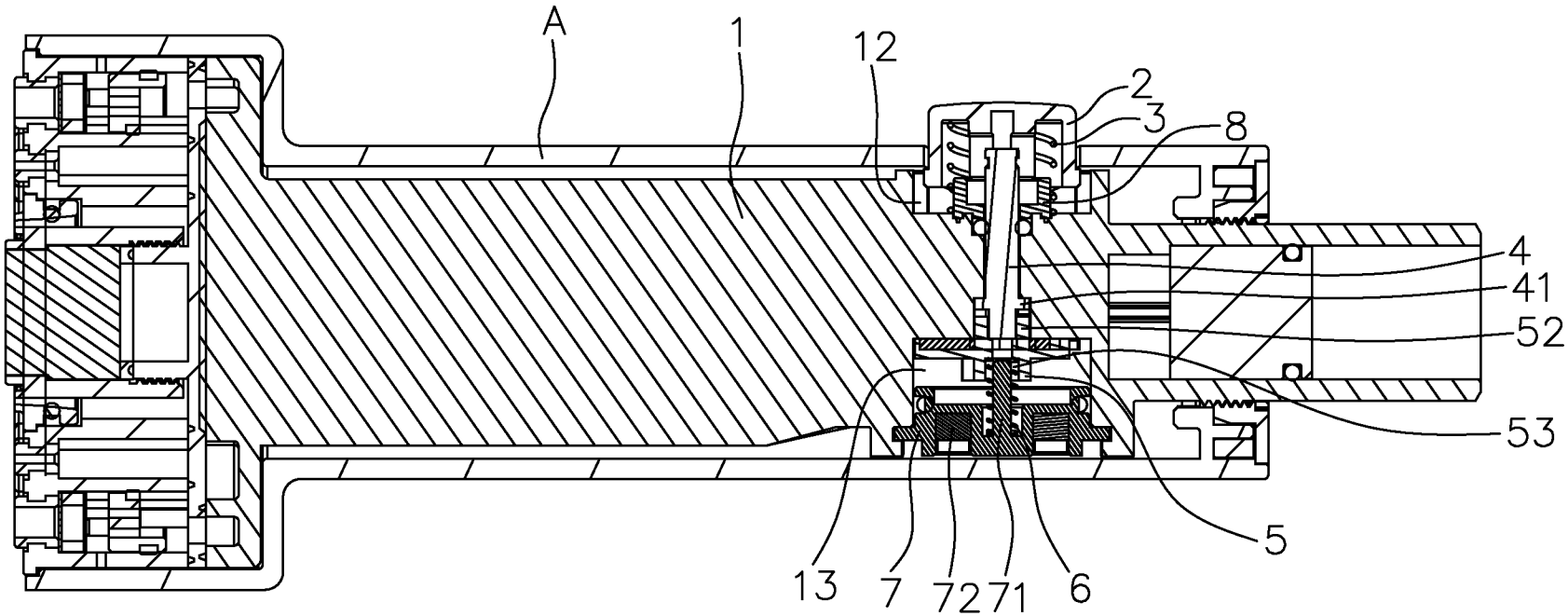
FIG. 4 is a vertical sectional view of the present invention (state 1)
Figure 5:
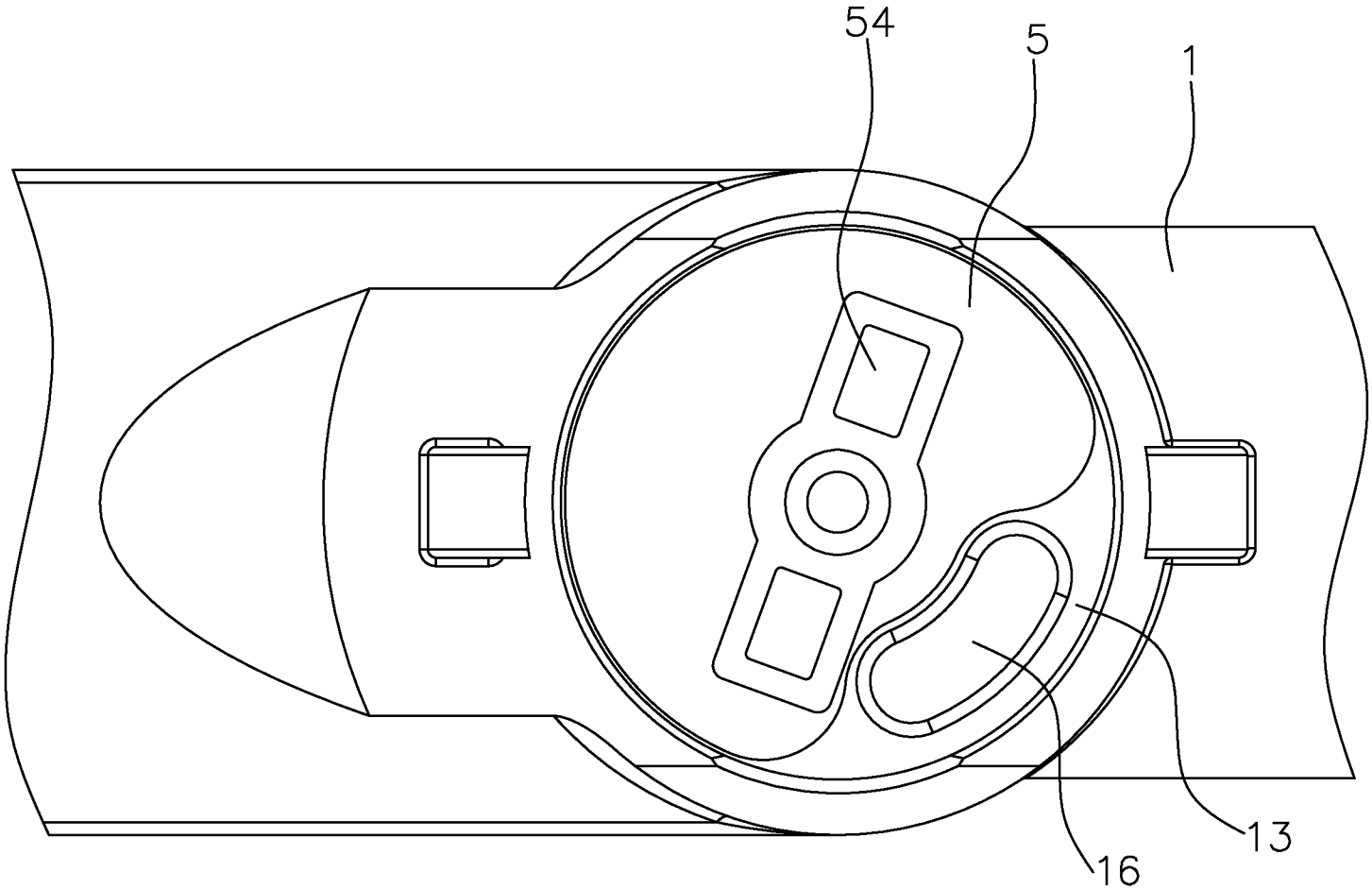
FIG. 5 is a transverse sectional view of the present invention (state 1)

When the outflow switch mechanism of the present invention is in a normal state, as shown in FIG. 4 and FIG. 5, the button 2 is biased by the return spring 3 to extend out of the shower handle housing A. The water division plate 5 is biased by the support press spring 6 to lean against the bottom of the chamber 13, namely, the water inlet 16 of the chamber 13 has a water division state. The toothed blocks 52 of the water division plate 5 extend in the enlarged seat 15 of the valve chamber 11 to mate with the sliding grooves 151.

Figure 6:
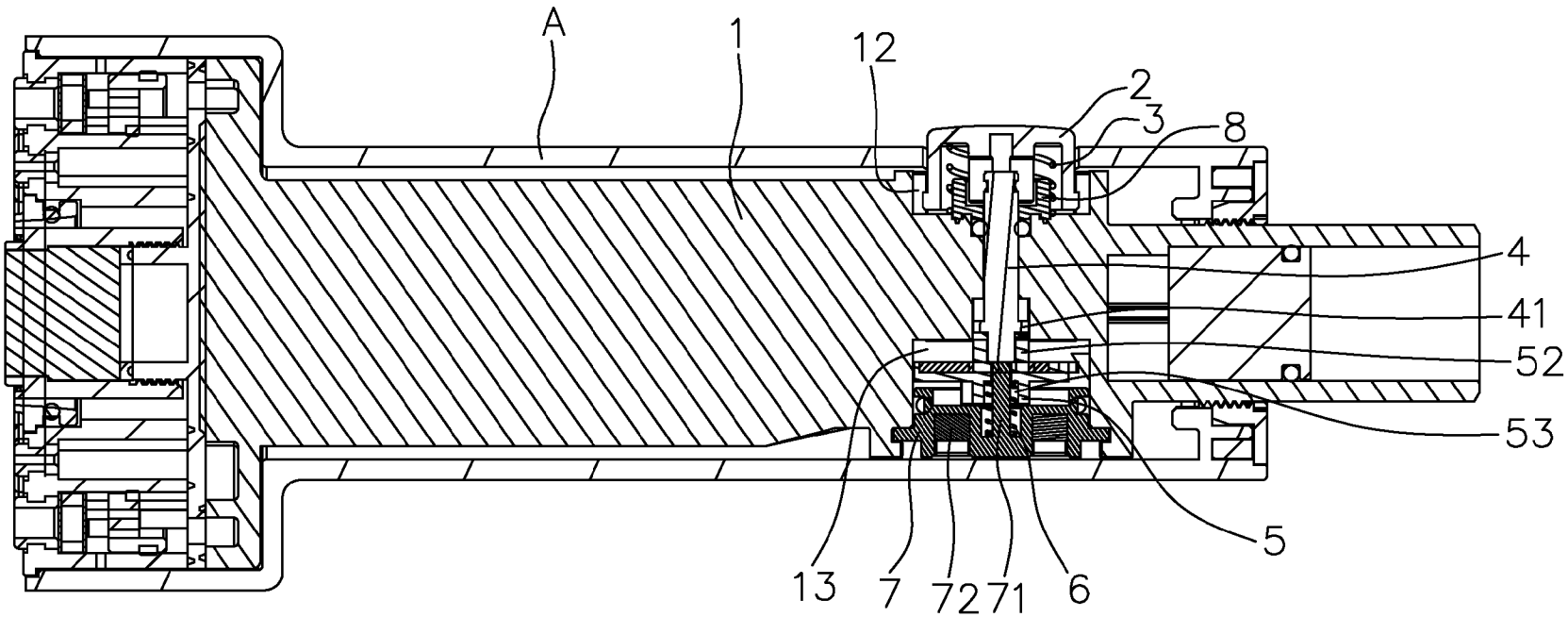
FIG. 6 is a vertical sectional view of the present invention (state 2)
Figure 7:
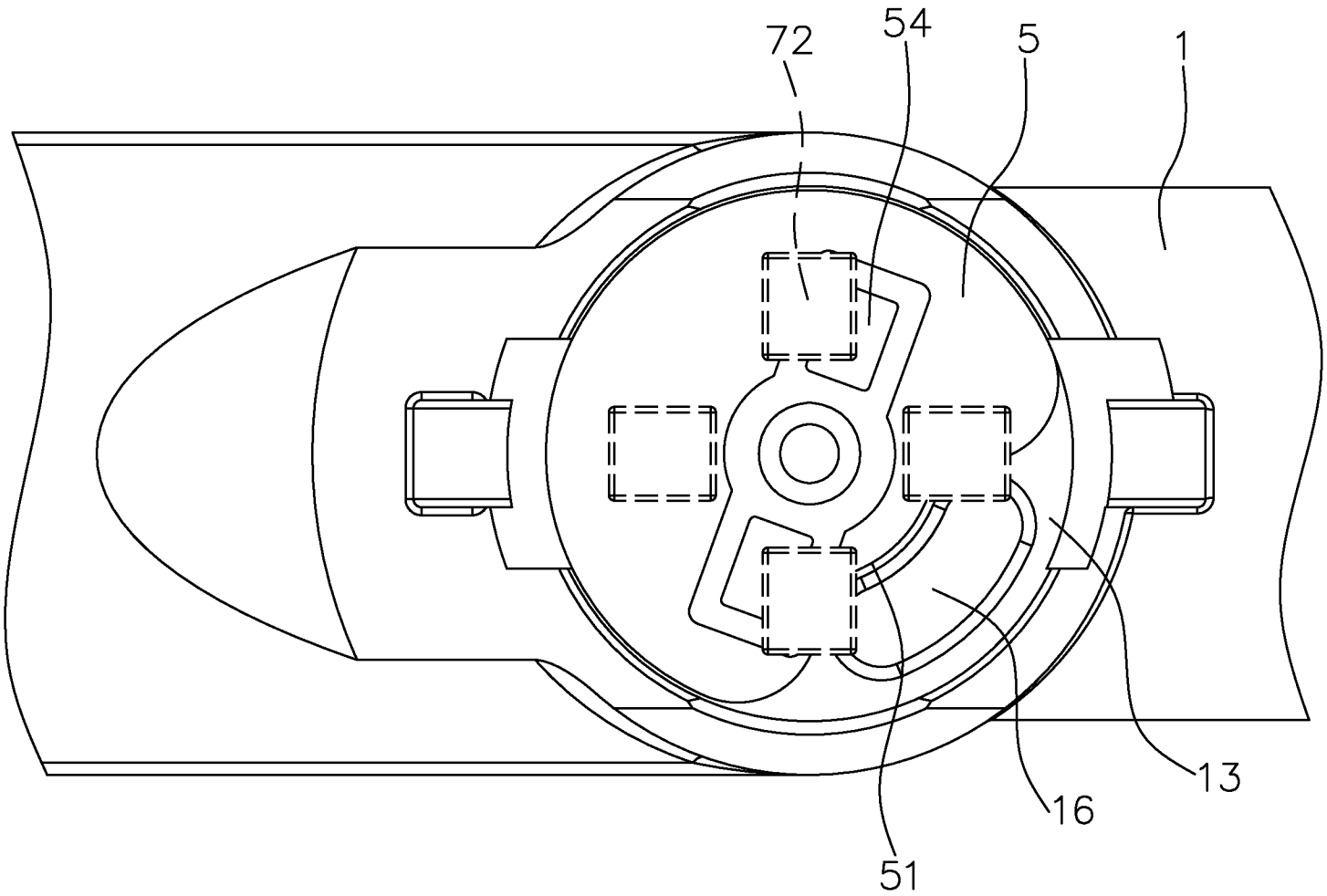
FIG. 7 is a transverse sectional view of the present invention (state 2)
Figure 8:
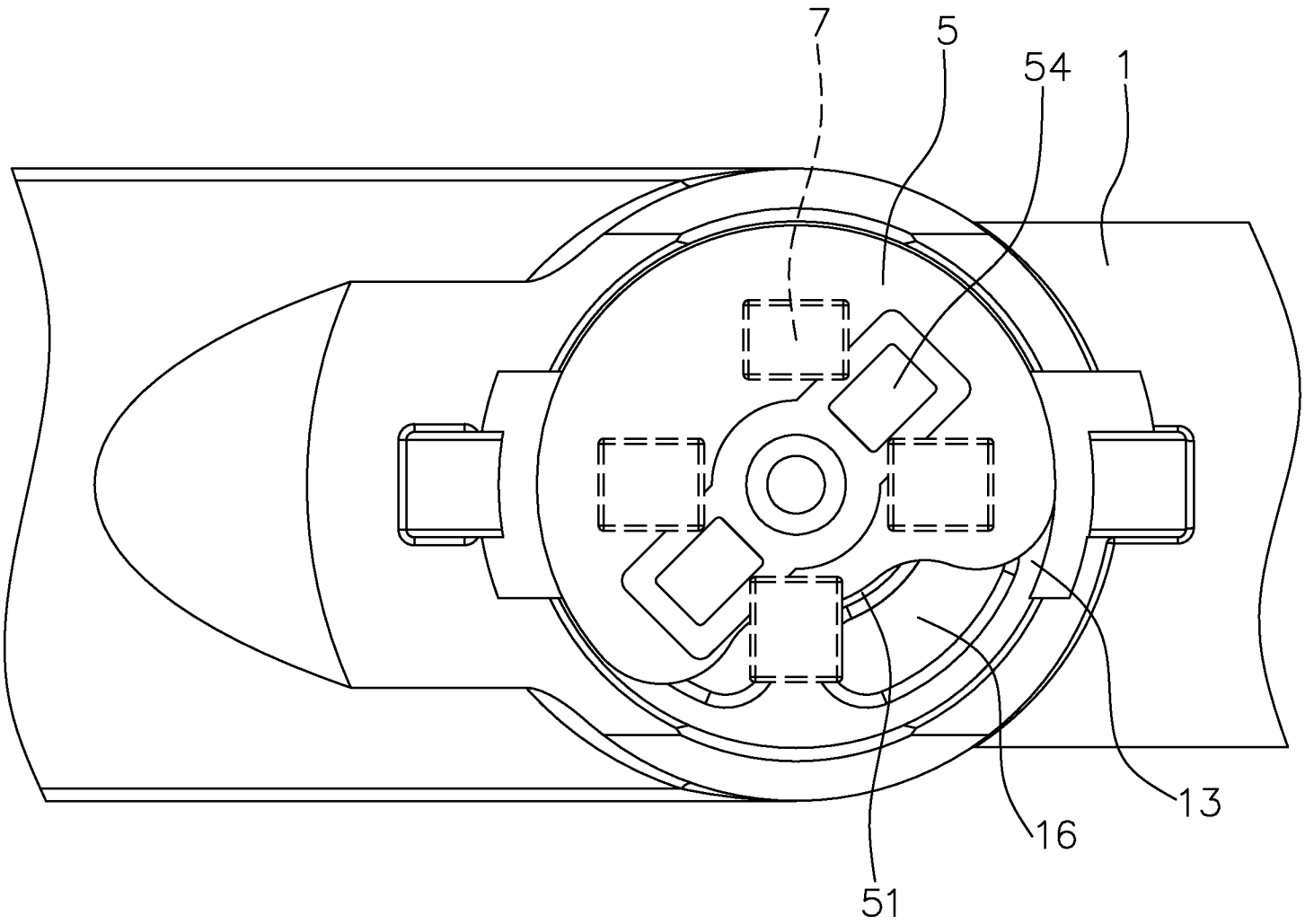
FIG. 8 is a transverse sectional view of the present invention (state 3)
Figure 9:
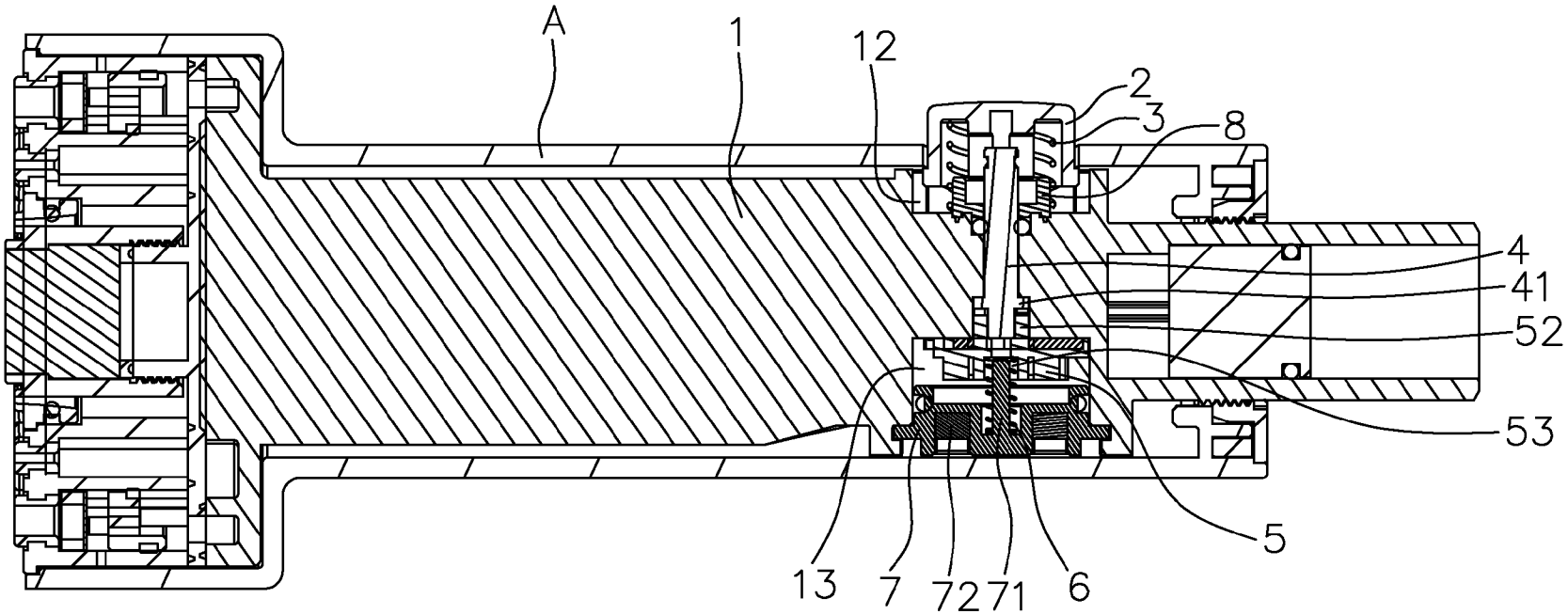
FIG. 9 is a vertical sectional view of the present invention (state 4)
Figure 10:
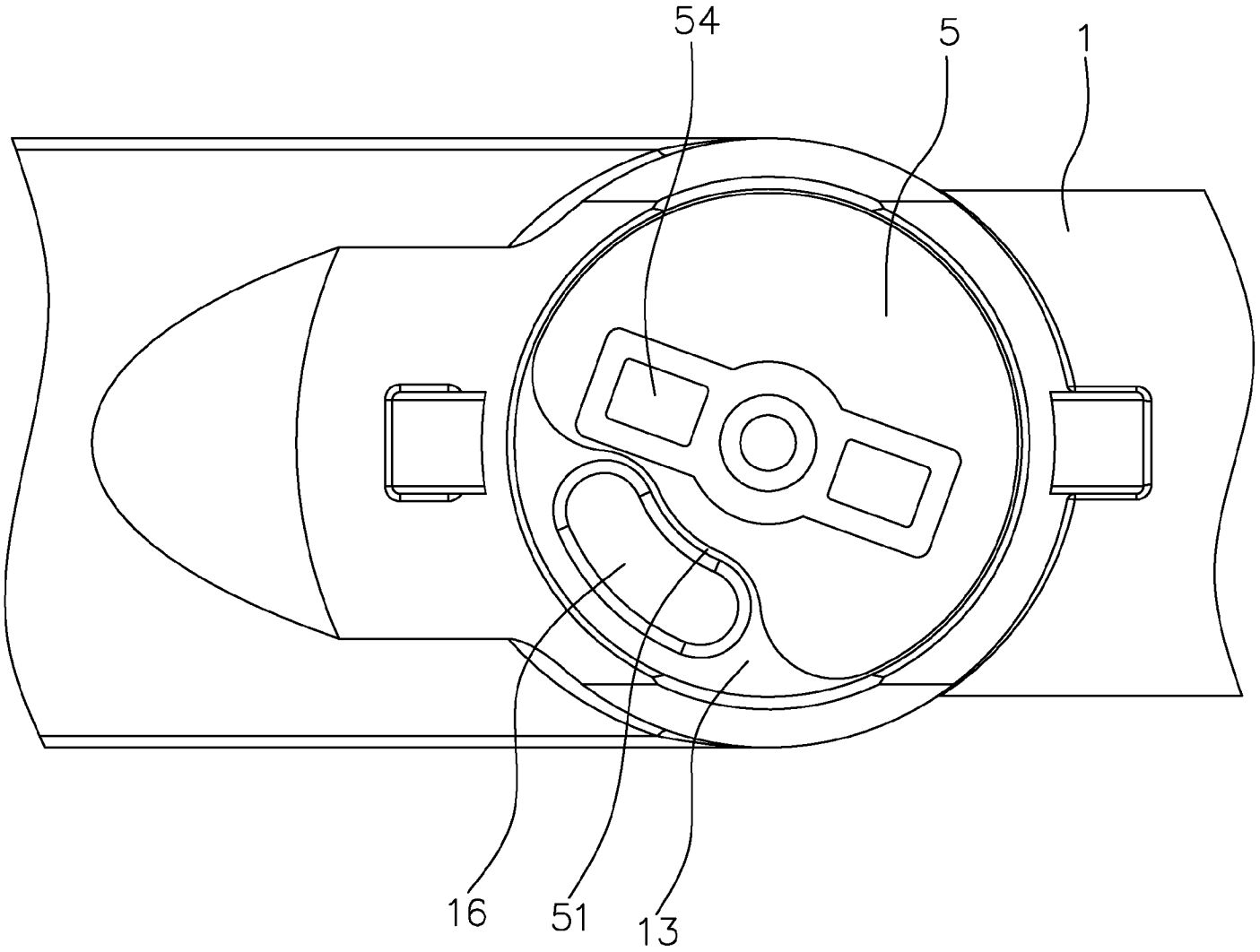
FIG. 10 is a transverse sectional view of the present invention (state 4)

When the outflow switch mechanism of the present invention is operated, as shown in FIG. 6 and FIG. 7, the button 2 is pressed to move the valve shaft 4 downward. At this moment, the return spring 3 is in a compressed energized state. The valve shaft 4 pushes the water division plate 5 to move downward to compress the support press spring 6. When the toothed blocks 52 of the water division plate 5 disengage from the enlarged seat 15 of the inner body 1, the two magnets 54 of the water division plate 5 and the four magnets 72 of the cover 7 will repulse each other because of the same magnetism, and the water division plate 5 will turn 25 degrees as shown in FIG. 8. As shown in FIG. 9 and FIG. 10, when the button 2 is released, the button 2 biased by the return spring 3 will bring the valve shaft 4 to return and the water division plate 5 biased by the support press spring 6 is moved toward the enlarged seat 15. When the gradient surface 521 of the toothed block 52 of the water division plate 5 is contact with gradient guide surface 152 of the enlarged seat 15, the water division plate 5 will keep on turning 65 degrees by push of the gradient guide surface 152 while moved upward. The water division plate 5 is turned to control the water inlet 16 so as to switch water outflow.

In the aforesaid embodiment, the number of the magnets 72 of the cover 7 is four and the turning angle of the water division plate 5 is explained as an example, they can be changed and are not limited. The number of the magnets and the turning angle of the water division plate can be changed according to the number of the water outflow modes. Through the magnet to drive the water division plate 5, the present invention can switch the water outflow modes.

Accordingly, the one-way bevel toothed block 52 of the water division plate 5 is to cooperate with the gradient guide surface 152 of the projecting rib 153, and the magnet 54 of the water division plate 5 is to cooperate with the magnet 72 of the cover 7. The water division plate 5 will be turned by the repulsion of the homogeneous magnets to switch the water outflow mode when it departs from the inner body 1. The whole mechanism is simple in construction, and the parts can be processed with ease to enhance the work efficiency. The present invention uses the repulsion of the homogeneous magnets to slant the angle and the switch of the bevel toothed block, preventing the water division plate to get contact with the parts direct. The feeling of switching by one hand is convenient.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An outflow switch mechanism of a multi-function shower head, the outflow switch mechanism being disposed in a water path of the shower head and comprising an inner body, a button, a return spring, a valve shaft, a water division plate, a support press spring and a cover;

the inner body having a valve chamber (11) extending up and down, an upper portion of the valve chamber (11) being formed with a seat to accommodate the return spring and the button; a lower portion of the valve chamber (11) being formed with a chamber (13) having a water inlet to accommodate the water division plate, the support press spring and the cover;

a valve path for accommodating the valve shaft being defined between the seat and the chamber (13), the button being connected with an upper end of the valve shaft; a lower portion of the valve path being formed with an enlarged seat, the enlarged seat having longitudinal sliding grooves on a side wall thereof and a projecting rib formed between the sliding grooves, a lower portion of the valve shaft extending in the enlarged seat, the projecting rib having a gradient guide surface at a bottom thereof;

the water division plate having a toothed block on an upper central surface thereof corresponding to the sliding grooves;

the toothed block having a gradient surface at a top thereof corresponding to the gradient guide surface of the projecting rib;

the water division plate further having a magnet (54) thereon, and the cover having a magnet (72) thereon.

2. The outflow switch mechanism of a multi-function shower head as claimed in claim 1, wherein the water division plate has one or more magnets (54).

3. The outflow switch mechanism of a multi-function shower head as claimed in claim 1, wherein the cover has one or more magnet (72), and the number of the sliding grooves corresponds to the number of water chambers.

4. The outflow switch mechanism of a multi-function shower head as claimed in claim 1, wherein a support block is provided at a lower end of the button for insertion of the valve shaft, and the support block cooperates with a seal member to seal the valve shaft and a valve path.

5. The outflow switch mechanism of a multi-function shower head as claimed in claim 1, wherein the valve shaft is a rod, and a lower portion of the valve shaft has a stop block on a side wall thereof to slide along one of the sliding grooves.

6. The outflow switch mechanism of a multi-function shower head as claimed in claim 1, wherein the water division plate has a crescent notch and at least one toothed block on an upper central surface thereof, and the water division plate has a counterbore on a lower central surface thereof to accommodate the support press spring.

7. The outflow switch mechanism of a multi-function shower head as claimed in claim 1 or 6, wherein a lower surface of the water division plate further has fixing recesses to fix a total of two magnets (54), and the two magnets (54) are disposed radially and symmetrically.

8. The outflow switch mechanism of a multi-function shower head as claimed in to claim 1, wherein the cover is an end cover to cover the chamber (13), and the cover has a central protruding post extending upward for the support press spring to fit thereon.

9. The outflow switch mechanism of a multi-function shower head as claimed in claim 1 or 8, wherein the cover comprises a total of four magnets (72) on a lower surface thereof, and the magnets (72) are spaced evenly and fixed on the cover.

* * * * *